US005219234A

United States Patent [19]

Sakai

[11] Patent Number: 5,219,234

[45] Date of Patent: Jun. 15, 1993

[54] THERMAL PRINTING DEVICE INCLUDING JAM DETECTION MEANS

[75] Inventor: Katsuyuki Sakai, Nara, Japan

[73] Assignee: Sharp Kabushiki Kaisha, Osaka, Japan

[21] Appl. No.: 768,805

[22] Filed: Sep. 30, 1991

[30] Foreign Application Priority Data

| | | | |
|---|---|---|---|
| Oct. 2, 1990 | [JP] | Japan | 2-265374 |
| Oct. 2, 1990 | [JP] | Japan | 2-265375 |
| Oct. 2, 1990 | [JP] | Japan | 2-265376 |
| Oct. 2, 1990 | [JP] | Japan | 2-265377 |
| Oct. 2, 1990 | [JP] | Japan | 2-265378 |

[51] Int. Cl.[5] ..... B41J 2/32

[52] U.S. Cl. ..... 400/120; 358/296; 400/708

[58] Field of Search ..... 358/296, 304, 486; 400/120, 708, 621; 101/233, 234; 226/43, 37, 35, 27, 100

[56] References Cited

U.S. PATENT DOCUMENTS

| | | | |
|---|---|---|---|
| 3,779,440 | 12/1973 | Casale et al. | 226/100 |
| 4,031,519 | 6/1977 | Findley | 400/65 |
| 4,359,179 | 11/1982 | Waiss | 226/43 |
| 4,470,349 | 9/1984 | Godlewski | 101/233 |
| 4,560,990 | 12/1985 | Sue et al. | 400/621 |
| 4,690,577 | 9/1987 | Kikuchi et al. | 400/708 |
| 4,709,149 | 11/1987 | Takahashi et al. | 400/120 |
| 4,793,605 | 12/1988 | Tajima | 400/708 |
| 4,909,649 | 3/1990 | Okunomiya | 400/120 |
| 4,913,567 | 4/1990 | Imamaki et al. | 400/120 |
| 4,914,452 | 4/1990 | Fukawa | 400/120 |
| 4,949,097 | 8/1990 | Imaseki | 400/120 |
| 4,963,988 | 10/1990 | Baba | 358/296 |
| 4,983,854 | 1/1991 | Mizuno et al. | 400/708 |
| 5,005,026 | 4/1991 | Sakai | 400/120 |
| 5,014,135 | 5/1991 | Ijuin et al. | 358/296 |
| 5,041,845 | 8/1991 | Ohkubo et al. | 400/120 |
| 5,062,722 | 11/1991 | Shiozaki et al. | 400/120 |

FOREIGN PATENT DOCUMENTS

| | | |
|---|---|---|
| 0153859 | 9/1985 | European Pat. Off. . |
| 0361915 | 4/1990 | European Pat. Off. . |
| 54-9932 | 1/1979 | Japan . |
| 58-146173 | 8/1983 | Japan . |
| 61-13864 | 1/1986 | Japan . |

OTHER PUBLICATIONS

Patent Abstracts of Japan, vol. 8, No. 195, Sep. 7, 1984.

*Primary Examiner*—Edgar S. Burr
*Assistant Examiner*—Lynn D. Hendrickson
*Attorney, Agent, or Firm*—David G. Conlin; George W. Neuner

[57] ABSTRACT

A thermal printing device for printing an image data on a thermosensible paper includes a platen roller for conveying the thermosensible paper, a thermal head having a plurality of heater elements provided in opposition to the platen roller, a unit for pressing the thermal head against the platen roller with the thermosensible paper laid therebetween when the image data is printed on the thermosensible paper, a unit for controlling the pressing unit to release the thermal head out of a pressing state against the platen roller under predetermined conditions, and a unit for selectively actuating the heater elements in accordance with the image data.

8 Claims, 15 Drawing Sheets

THERMAL PRINTING DEVICE INCLUDING JAM DETECTION MEANS

BACKGROUND OF THE INVENTION

1. Field of the Invention

The present invention relates to a thermal printing device for printing an image data on a thermosensible paper.

2. Description of the Related Art

The inventor of the present invention knows a facsimile apparatus now widely used for sending or receiving image data such as characters or graphics to or from remote devices through a public phone circuit. Such the facsimile apparatus includes a thermal printing device which prints a converted image data on a thermosensible paper. The converted image data is converted by a facsimile receiver which receives electric picture signals and performs a conversion of the received electric picture signals to the image data. The thermal printing device has a platen roller and a thermal head between which a thermosensible recording paper is tightly held. The converted image data is printed on the thermosensible paper tightly held therebetween. The thermosensible paper is rolled and accommodated with in the facsimile apparatus.

In order to reliably print the converted image data received intermittently, the rolled thermosensible paper is stocked sufficiently. Further, it is necessary to prevent printing disability caused by exhaust of ink and operating failure caused when the facsimile apparatus itself is moved, for example.

In case that the image data is printed when the thermosensible paper is hardly left, the thermosensible paper may be used up while the image data is being printed. So, in case that the thermosensible paper is hardly left, the thermal printing device takes the steps of sensing a mark indicating that the remaining length of the thermosensible paper is less than a predetermined length, displaying a message that the thermosensible paper should be replaced, and stopping printing of the image data until the thermosensible paper is newly replaced.

That is, when the remaining length of the thermosensible paper is less than the predetermined length, as mentioned above, the thermal printing device keeps a waiting state until the thermosensible paper is replaced. Printing on the thermosensible paper is carried out in the state where the thermosensible paper is tightly held between the platen roller and the thermal head so that the thermal head is pressed against the platen roller. When waiting for the new thermosensible paper to be replaced, the thermal head is being pressed against the platen roller. Hence, when the thermosensible paper is replaced, it is necessary to take troublesome steps of taking out the old thermosensible paper, mounting the new thermosensible paper, and pressing the thermal head against the platen rollers with the thermosensible paper laid therebetween again.

Since the facsimile apparatus intermittently receives the electric picture signals, no one can estimate when a replacement of the thermosensible paper is required. Therefore, some unflavorable situations may take place such as where the replacement of the thermosensible paper is required while the electric picture signals are being received and where a user unfamiliar to handling of the thermosensible paper has to replace the thermosensible paper. In such situations, the burdensome operation is that the thermosensible paper has to be released out of the pressure given by the thermal head and the platen roller. If this operation is skipped, the portion of the thermosensible paper tightly held between the thermal head and the platen roller is torn out when the old thermosensible paper is being replaced, resulting in disadvantageously needing more troublesome operation for removing the torn paper.

In turn, a second disadvantage of the thermal printing device will be described.

As mentioned above, the thermal printing device included in the facsimile apparatus, for example, serves to tightly hold the thermosensible paper between the platen roller and the thermal head. When the image data is received, the platen roller is rotated so that the thermosensible paper is conveyed in one direction and heater elements included in the thermal head is actuated by an electric power. The heater elements are arranged in a vertical manner to the conveying direction of the thermosensible paper and are selectively heated in synchronous to the paper conveyance, resulting in printing the image data on the thermosensible paper.

The thermal printing device of the facsimile apparatus provides a mechanism for temporarily reducing a pressure constantly kept between the thermal head and the platen roller or moving the thermal head for releasing the pressure kept therebetween. For example, the thermosensible paper is formed so that it can fit in a cabinet of the facsimile apparatus. By opening a part of the cabinet, the pressure applied against the thermal head is released. By closing the cabinet, the pressure is applied to the thermal head so that the thermosensible paper is tightly held between the platen roller and the thermal head. Alternatively, it is also possible to provide a pressure-releasing lever by which the pressure can be released.

In the thermal printing device provided in the facsimile apparatus, even when printing is terminated, the platen roller serves to press the thermosensible paper against the thermal head. The force of pressure is as high as 4 Kg for 200 mm length of the thermosensible paper. This force is considered to be relatively high. The facsimile apparatus has to constantly keep the waiting state until the electric picture signals are received. Hence, the pressure is kept for a considerable time.

The platen roller is formed of an elastic material such as rubber so that the thermosensible paper becomes suitable to conveyance and printing. The platen roller pressed by the thermal head for a considerable time is transformed, resulting in causing an eternal compression distortion on the platen roller and implementing no exact printing.

To reduce such an adverse effect, it is necessary to use an expensive rubber material on which an eternal distortion is hardly caused. It results in enhancing the manufacturing cost of the facsimile apparatus. Further, since a larger pressure is caused for a considerable time, the thermal printing device has to be stiff enough to be transformed by the reaction of the platen roller. It is therefore difficult to reduce the thermal printing device in size.

In turn, a third disadvantage of the thermal printing device will be described.

When an abnormal state takes place in conveying the thermosensible paper, printing of the image data cannot be properly carried out in synchronous to the conveyance of the thermosensible paper as well as the thermosensible paper may be stuffed in the conveying direction so that an excessive burden may be applied on the mechanism for conveying the thermosensible paper, resulting in partially damaging the thermal printing device. The thermal printing device, therefore, senses an abnormal state, that is, a paper jam in the conveying direction so that the thermal printing device immediately stops to function if the abnormal state is sensed.

In this case, the thermal printing device stops its operation as it is, that is, in the state that the platen roller is pressed against the thermal head when an abnormal state is sensed in the paper conveying path. In order to remove an abnormal state in the conveying direction, therefore, it is necessary to remove the cause of the abnormal state appearing in the paper conveying path after the pressure caused between the platen roller and the thermal head is released.

In order to remove the abnormal state in the conveying path without releasing the pressure of the thermal head against the platen roller, a portion of the thermosensible paper is torn out as it is tightly held between the thermal head and the platen roller. Hence, it is more difficult to remove the torn portion.

SUMMARY OF THE INVENTION

It is a first object of the present invention to provide a thermal printing device which is capable of easily replacing an old thermosensible paper with a new one when the old thermosensible paper is used up.

It is a second object of the present invention to provide a thermal printing device which is capable of preventing the thermal head from being continuously pressed against the platen roller, using an inexpensive material for forming the platen roller, and reducing the bulk and weight of the thermal printing device itself.

It is a third object of the present invention to provide a thermal printing device which is capable of easily removing an abnormal state when the abnormal state takes place in conveying the thermosensible paper.

The objects of the invention can be achieved by a thermal printing device for printing an image data on a thermosensible paper, including:

a platen roller for conveying the thermosensible paper;

a thermal head having a plurality of heater elements provided in opposition to the platen roller;

a unit for pressing the thermal head against the platen roller with the thermosensible paper laid therebetween when the image data is printed on the thermosensible paper;

a unit for controlling the pressing unit to release the thermal head out of a pressing state against the platen roller under predetermined conditions; and a unit for selectively actuating the heater elements in accordance with the image data.

In operation, the thermosensible paper is tightly held between the platen roller and the thermal head so that the thermosensible paper is conveyed through the effect of the platen roller. The heater elements are selectively actuated by the actuating unit for printing on the thermosensible paper held therebetween. Under predetermined conditions, for example, when the thermosensible paper is used up, the thermosensible paper is automatically released by the controlling unit out of the pressure given by the platen roller and the thermal head. When the thermosensible paper is replaced, therefore, it is not necessary to take the troublesome operation of releasing the thermosensible paper out of the pressure given by the platen roller and the thermal head so that any user can easily and rapidly replace the thermosensible paper. In particular, when even a user unfamiliar to the operation replaces the thermosensible paper, he or she can easily remove the finished thermosensible paper around the platen roller.

Alternatively, for example, when the remaining length of the thermosensible paper is less than a predetermined length, the pressure caused between the platen roller and the thermal head is automatically released. Hence, it is simply possible to remove the rolled paper and mount the new thermosensible paper.

Further, since the thermosensible paper is allowed to be rapidly and reliably replaced, it results in reducing the interrupting time of the data receipt even if the thermosensible paper is used up while the image data is being received.

The thermal printing device keeps the waiting state until the new thermosensible paper is mounted. Even in case the waiting time is longer than expected as a result of the clumsy operation, it is possible to prevent an eternal compression distortion from being caused on the platen roller, because no pressure is applied to the platen roller by the thermal head.

Further, for example, when the printing is finished, the pressure of the platen roller against the thermal head is released by the controlling unit. Hence, when no printing is done, it is possible to prevent the thermal head from being pressed against the platen roller for a considerable time.

As mentioned above, after terminating the printing, the pressure of the thermal head against the platen roller is released. The thermal printing device has to keep the waiting state for a considerable time until the image data is received. By releasing the pressure of the thermal head against the platen roller after terminating the data printing, under the foregoing waiting state, the platen roller is not transformed even if the same portion of the platen roller comes into contact with the thermal head. It is therefore possible to prevent occurrence of an eternal compression distortion and avoid transformation of the platen roller, resulting in implementing exact printing of the image data.

Since no substantial transformation is caused in the platen roller, it is possible to employ an inexpensive rubber material for the platen roller, resulting in reducing the manufacturing cost of the device. Since a large pressure is caused for quite a short time, the present thermal printing device does not need so large stiffness as the known thermal printing device. Hence, the present thermal printing device can be reduced in size and made lightweight.

Further, in case the thermal printing device is transferred in use, the smaller pressure caused between the thermal head and the platen roller serves to buffer the external shock applied from the thermal head to the platen roller, resulting in preventing transformation of the platen roller.

Further, for example, when an abnormal state takes place in the conveyance of the thermosensible paper, the pressure caused between the platen roller and the thermal head is automatically released by the controlling unit. It is therefore unnecessary to take the step of releasing the pressure caused therebetween, resulting in easily and rapidly removing the cause of the abnormal state appearing in the conveyance of the thermosensible paper.

Since the thermal printing device is capable of rapidly recovering the abnormal state in the conveyance of the thermosensible paper, it is possible to reduce the printing-interrupting state as much as possible.

Further objects and advantages of the present invention will be apparent from the following description of the preferred embodiment of the invention as illustrated in the accompanying drawings.

DESCRIPTION OF THE PREFERRED EMBODIMENTS

Embodiments of the present invention is described hereinafter in detail with reference to the drawings.

Figure 1:
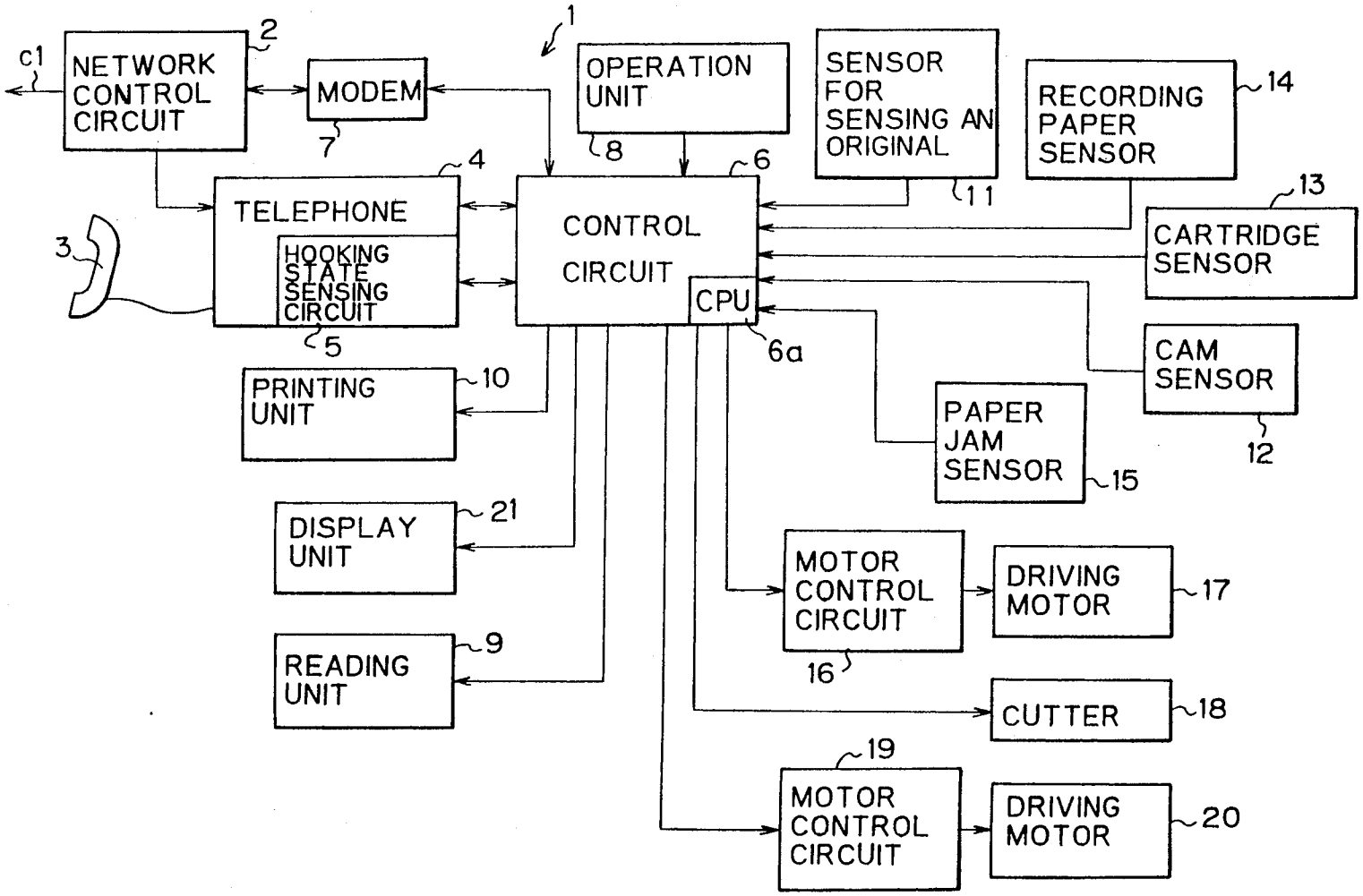
FIG. 1 is a block diagram showing electric arrangement of a facsimile apparatus which includes the thermal printing device according to the present invention.

FIG. 1 is a block diagram showing electric arrangement of a facsimile apparatus having a thermal printing device according to an embodiment of the present invention.

As shown in FIG. 1, a reference numeral 1 denotes a facsimile apparatus which provides a network control circuit 2 being connected to a public phone circuit c1. This network control circuit 2 serves to control the network connected between the public phone circuit c1 and the facsimile apparatus 1. The network control circuit 2 is connected to a telephone 4 which provides a handset 3 having a speaker and an earphone. The telephone 4 has a hooking state sensing circuit 5. The hooking state sensing circuit 5 is connected to a control circuit 6 composed of a microcomputer or the like.

A modem 7 is provided between the control circuit 6 and the network control circuit 2. The modem 7 serves to modulate and demodulate a carrier signal to be sent or received by the facsimile apparatus 1 through the public phone circuit c1.

The control circuit 6 is connected to an operation unit 8 including dialing keys and a start key, a reading unit 9 for optically reading an image of an original mounted to the facsimile apparatus 1, and a printing unit 10 for printing an image data received through the public phone circuit c1.

A reference numeral 11 denotes a sensor for sensing the original. The sensor 11 for sensing the original is composed of a microswitch or the like. The sensor 11 supplies a sensing signal to the control circuit 6 when the original is sensed. Likewise, a cam sensor 12 is provided in relation to the printing unit 10 and a cartridge sensor 13 is also provided for sensing whether or not a printing cartridge is mounted. Those sensors 12 and 13 respectively supply the sensing signals to the control circuit 6.

A reference numeral 14 denotes a recording paper sensor, which serves to sense whether or not the thermosensible recording paper 24 (see FIG. 2) is present. A reference numeral 15 denotes a paper jam sensor which serves to sense a paper jam, that is, the thermosensible paper 24 being rolled around a platen roller. Those sensors 14, 15 are composed of reflective type optical sensors respectively and supply the sensing signals to the control circuit 6.

When an image signal corresponding to an image data is received, the control circuit 6 actuates a motor control circuit 16 to control a driving motor 17 so that the thermosensible paper is allowed to be conveyed. The control circuit 6 actuates the printing unit 10 to print the image data and then actuates a cutter 18 to cut the thermosensible paper. When an image signal is transmitted to the public phone circuit cl, the control circuit 6 actuates a motor control circuit 19 to operate a driving motor 20 forward so as to convey the original. When the image signal is received, the driving motor 20 is reversed for allowing the printing to be implemented in the printing unit 10.

A reference numeral 21 denotes a display unit which is composed of a liquid crystal display, for example. This display unit 21 is located close to the operation unit 8. The control circuit 6 serves to display information containing various kinds of troubles.

Figure 2:
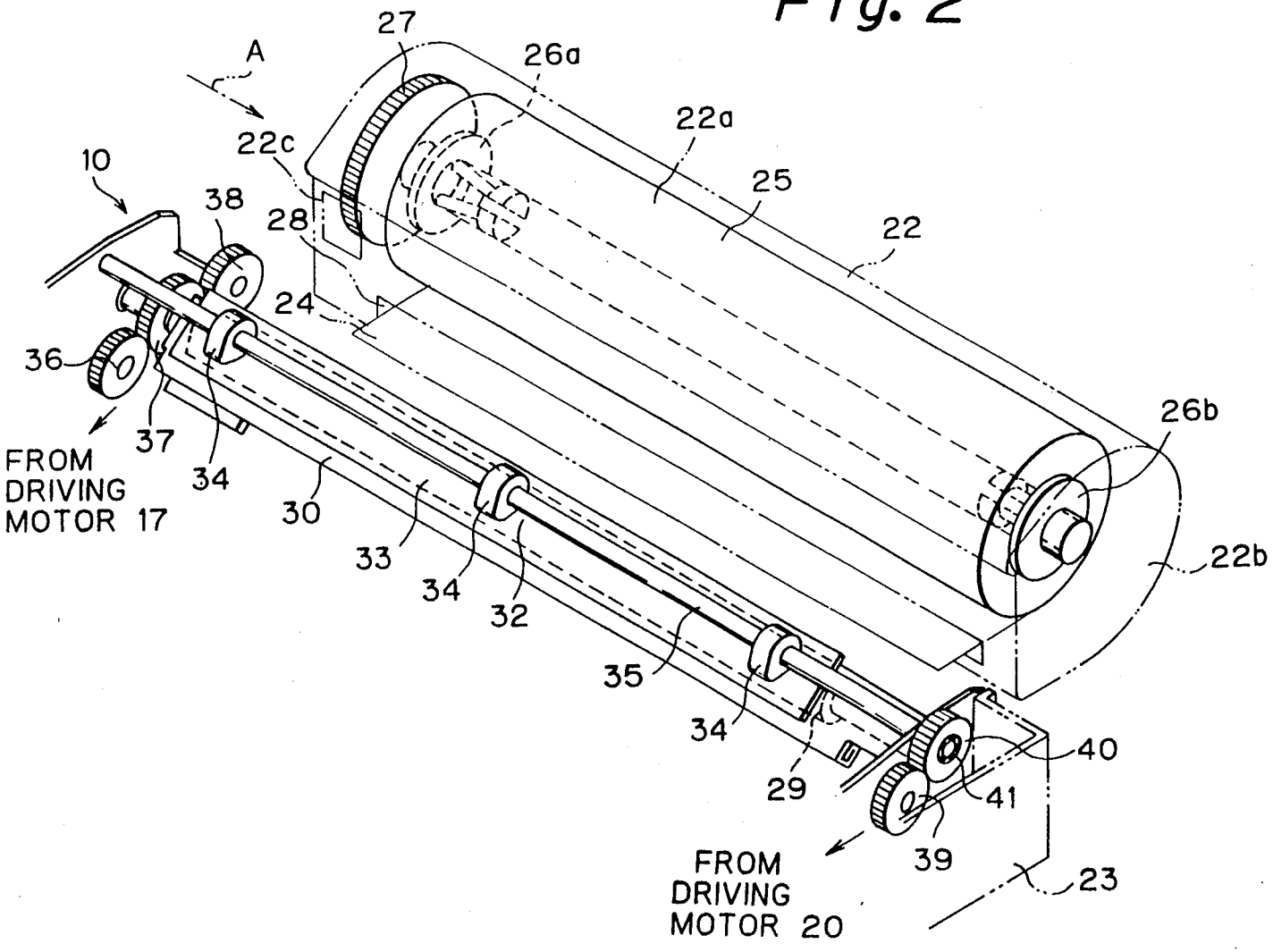
FIG. 2 is a perspective view showing combinational construction of a printing unit and a cartridge included in the thermal printing device.

FIG. 2 is a perspective view showing constructions of the printing unit 10 and the cartridge 22.

As shown in FIG. 2, the printing unit 10 is formed on one end of the cabinet 23 of the facsimile apparatus 1 from which the cartridge 22 is allowed to be detachable.

The cartridge 22 is formed to accommodate a paper roll 25. The thermosensible paper 24 has a surface 24*a* which develops a color by virtue of heat (see FIG. 7). The paper roll 25 is tightly held by a pair of spools 26*a* and 26*b*. One spool 26*a* is coaxially connected on a spool driving gear 27. The tip of the thermosensible paper 24 is pulled out of an opening 28 of the cartridge 22 and extends toward the side of the printing unit 10.

The cartridge 22 has an openable upper part 22*a* through which the paper roll 25 can be replaced. For the replacement of the paper roll 25, it is also possible to open the side 22*b* of the cartridge 22 on the side of the other spool 26*b*.

The printing unit 10 is formed of an elastic material such as rubber or the like and provides a platen roller 29 for conveying the thermosensible paper 24. The thermosensible paper 24 is tightly held between the platen roller 29 and a thermal head 30. The thermal head 30 includes a plurality of heater elements 31 provided in opposition to the platen roller 29 (described later with reference to FIG. 3). Those heater elements 31 are ranged the width direction of the thermosensible paper 24. According to an instruction of CPU (Central processing Unit) included in the control circuit 6, the heater elements 31 are selectively actuated by an electric power and heated in synchronous to the thermosensible paper 24 conveyed through the rotation of the platen roller 29. It results in printing the image data on the thermosensible paper 24.

The thermal head 30 is pressed against the platen roller 29 by means of spring 32. The spring 32 is supported on a supporting plate 33. The force of pressure is adjusted by pressing cams 34. The pressing cams 34 are composed of three cams having the same configuration, these three cams being connected on a cam shaft 35.

The platen roller 29 is rotated by the driving motor 17 (see FIG. 1). The driving force is transmitted from the driving motor 17 to the platen roller 29 through gears 36 and 37 for driving the platen roller. The gear 37 is fixed coaxially with the platen roller 29. The rotation of the gear 37 is transmitted to a gear 27 for driving a spool provided in the cartridge 22. The cartridge 22 provides an opening 22*c* for mating the gear 38 with the gear 27. The cam shaft 35 is rotated by the driving motor 20 (see FIG. 1). The driving force of the driving motor 20 is conveyed through gears 39 and 40 for driving the cam. The cam shaft 35 has the gear 40 fixed through a one-way clutch 41. The one-way clutch 41 is used for conveying the driving force to the cam shaft 35 only when the driving motor 20 is reversed in receiving an image signal.

Figure 3:
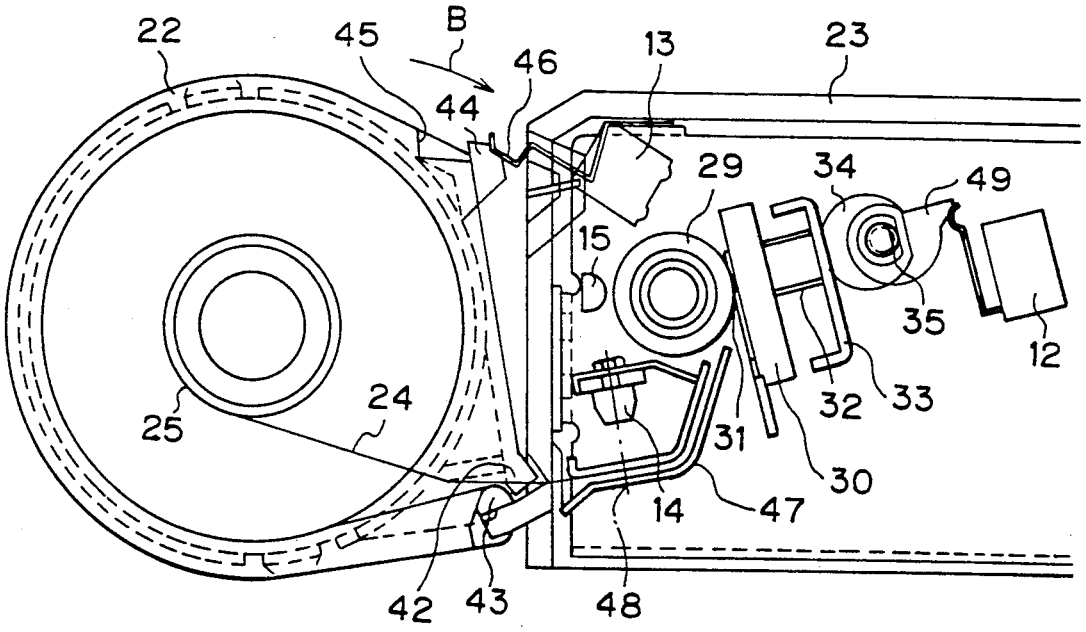
FIG. 3 is a sectional view showing the construction viewed from an arrow A of FIG. 2.

FIG. 3 is a sectional view showing the construction viewed from an arrow A of FIG. 2.

As shown in FIG. 3, to mount the cartridge 22 to the cabinet 23, the cartridge 22 has a lower end 42 and an upper end 44. The lower end 42 of the cartridge 22 is supported on a pivot 43 provided on the cabinet 23. Then, the upper end 44 of the cartridge 22 is angularly displaced in the direction of an arrow B. The upper end 44 has a lock supporting portion 45 to which a locking spring 46 provided on the cabinet 23 is fitted, resulting in fixing the cartridge 22 on the cabinet 23. When the cabinet 23 is mounted on cartridge 22, the cartridge sensor 13 composed of a microswitch supplies a signal.

The tip of the thermosensible paper 24 picked out of the paper roll 25 is guided between the platen roller 29 and the thermal head 30 through a guide member 47. Along the guide member 47, the recording paper sensor 14 is provided. The thermosensible paper sensor 14 serves to apply a ray of light along an optical axis 48 to the thermosensible paper 24 and sense the reflected light from the thermosensible paper 24 for the purpose of sensing whether or not the thermosensible paper 24 is located on the optical axis 48. The thermal head 30 is pressed against the platen roller 29 by the pressing cams 34. The pressure of the pressing cams 34 is transmitted through the supporting plate 33 and the spring 32 to the platen roller 29. The thermal head 30 provides heater elements 31 ranged on the contact portion between the thermal head 30 and the platen roller 29. The cam shaft 35 provides a driving member 49 coaxially with the pressing cams 34. When the pressing cams 34 presses the supporting plate 33, the driving member 49 serves to actuate the cam sensor 12. As mentioned above, the cam sensor 12 is composed of a microswitch. The paper jam sensor 15 is provided in opposition to the thermal head 30 with respect to the platen roller 29. The platen roller 29 is provided between the paper jam sensor 15 and the thermal head 30. The paper jam sensor 15 is composed of a light reflective sensor like the recording paper sensor 14.

Figure 4:
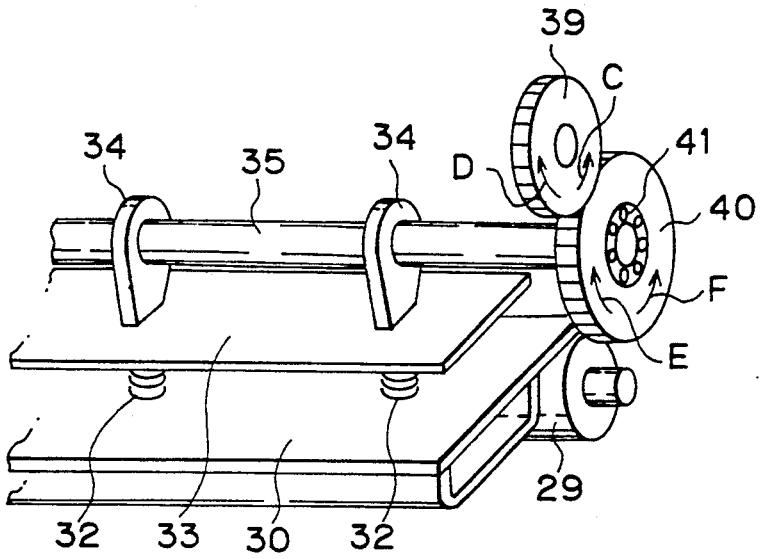
FIG. 4 is a perspective view showing a pressing mechanism for a thermal head included in the thermal printing device.

FIG. 4 is a perspective view showing a pressing mechanism for the thermal head 30 included in the printing unit 10.

As shown in FIG. 4, the gear 39 is connected to the driving motor 20 (see FIG. 1). In transmitting the image data, that is, in conveying the original, the driving motor 20 is rotated normally so that the gear 39 is rotated toward an arrow C and the gear 40 for driving the pressing cams 34 is rotated toward an arrow E. The one-way clutch 41, however, does not transmit the driving force from the gear 40 to the cam shaft 35. It means that the cam shaft 35 does not rotate when the gear 40 is rotated toward the arrow E. When the driving motor 20 is reversed, the gear 39 is rotated toward a D arrow and the gear 40 is rotated toward an F arrow, resulting in rotating the cam shaft 35 through the one-way clutch 41. The location of the rotated cams 34 is sensed by the cam sensor 12 through the driving member 49 shown in FIG. 3.

Figure 5:
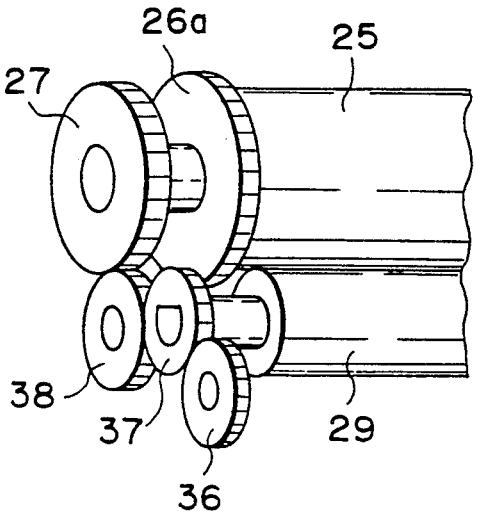
FIG. 5 is a perspective view showing a driving mechanism for rotating a platen roller and a paper roll included in the thermal printing device.

FIG. 5 is a perspective view showing a driving mechanism for rotating the platen roller 29 and the paper roll 25.

As shown in FIG. 5, the gear 36 is connected to the driving motor 17 (see FIG. 1). The driving motor 17 is rotated normally or reversed so that the force of the rotation is transmitted to the gears 37 and 38 for driving the platen roller and the gear 27 for driving the spool through the gear 36. The gear 37 is fixed on a rotating shaft. The rotating shaft is connected to the platen roller 28. The gear 27 is connected to the paper roll 25 through the spool 26*a*. With the normal or reverse operation of the driving motor 17, hence, the platen roller 29 and the paper roll 25 are allowed to rotate.

FIGS. 6A to 6F are views for illustrating the operating procedure according to the present embodiment.

Figures 6A, 6B, 6C, 6D, 6E, 6F:
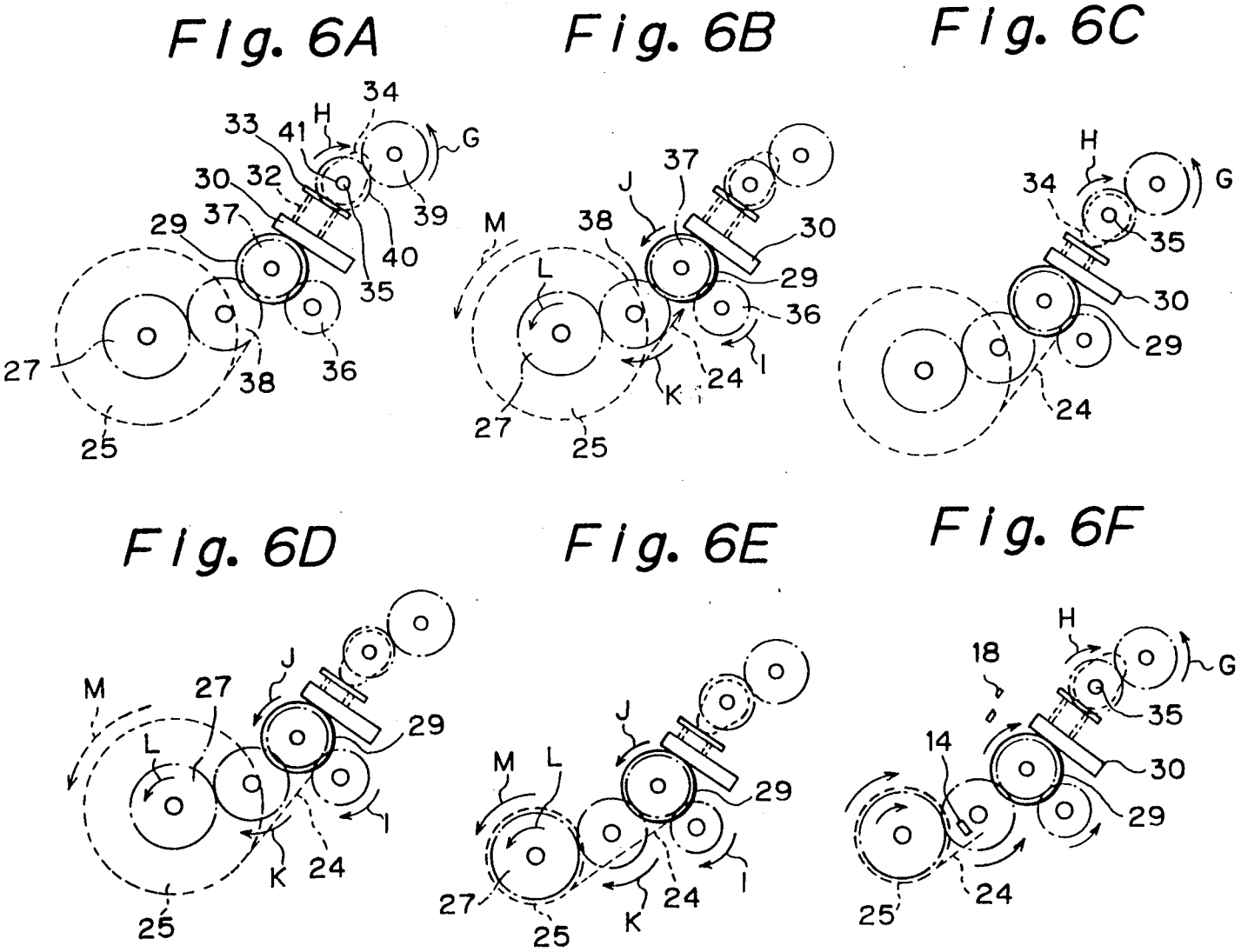
FIGS. 6A to 6F are views showing the operation done in the thermal printing device.

In FIG. 6A, the driving motor 20 (see FIG. 1) drives the gear 39 toward an arrow G and the gear 40 toward an arrow H. The rotation of the gear 40 results in angularly displacing the pressing cams 34 through the one-way clutch 41, thereby releasing the pressing state against the supporting plate 33. In the state shown in FIG. 6A, the paper roll 25 remains motionless.

In FIG. 6B, the driving motor 20 is stopped so that the thermal head 30 is released out of the pressing state against the platen roller 29. Then, the driving motor 17 (see FIG. 1) is rotated normally so that the gears 36, 37, 38 and 27 are rotated toward I, J, K and L arrows, respectively. It resulting in rotating the paper roll 25 toward an M so that the thermosensible paper 24 is conveyed toward the platen roller 29. Since the thermal head 30 is not pressed against the platen roller 29, in case that the thermosensible paper 24 does not reach the platen roller 29, the platen roller 29 is allowed to rotate in contact with the thermal head 30. The spool 26*a* is linked with the paper roll 25 by virtue of friction. When, therefore, the spool 26*a* is rotated, the paper roll 25 is also rotated so that the thermosensible paper 24 is moved toward the platen roller 29. After the thermosensible paper 24 reaches the platen roller 29, the thermosensible paper 24 is conveyed through the effect of the platen roller 29.

In FIG. 6C, the thermosensible paper 24 reaches a predetermined location as it is tightly held between the thermal head 30 and the platen roller 29, the driving motor 17 is stopped, the driving motor 20 is reversed so that the pressing cams 34 are angularly displaced, and thereby the thermal head 30 is pressed against the platen roller 29. This state shown in FIG. 6C indicates that preparation for printing the image data on the thermosensible paper 24 is completed.

FIG. 6D shows how printing is done on the paper roll 25 with a larger diameter just after mounting the new thermosensible paper. Since the platen roller 29 is connected to the spool 26*a* through a gear, the platen roller 29 has a certain relation with the spool 26*a* in light of the number of rotations. That is, the peripheral speed of the paper roll 25 with a larger diameter is adjusted to be substantially equal to the peripheral speed of the platen roller 29. It results in applying quite small tension to the thermosensible paper 24.

In FIG. 6E shows the state that the paper roll 25 has a smaller diameter after almost of the thermosensible paper 24 is used up. In this state, the peripheral speed of the paper roll 25 is made smaller than that of the paper roll 25 with a larger diameter. Hence, the platen roller 29 serves to pull the thermosensible paper 24 so that large tension takes place between the paper roll 25 and the spool 26*a* by virtue of friction caused therebetween. Since the paper roll 25 with a smaller diameter is likely to curl, such large tension makes great contribution to amend the curled paper.

Figure 7:
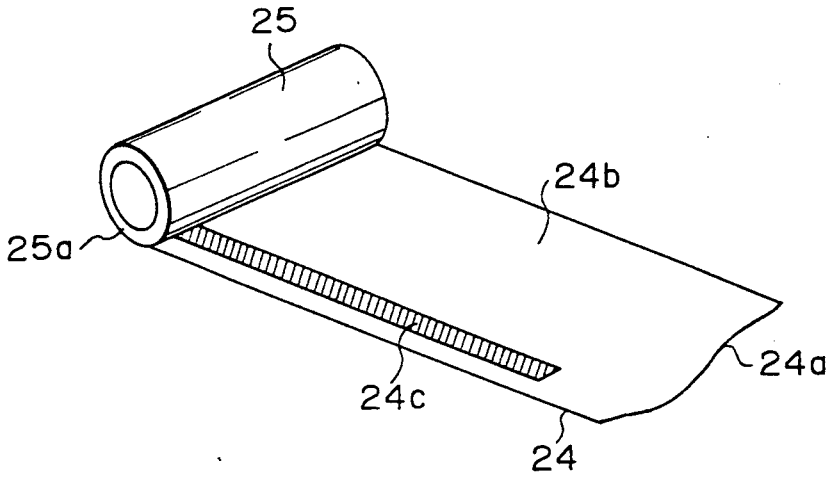
FIG. 7 is a perspective view showing an end mark located on the non-printing side of the thermosensible paper.

FIG. 6F shows how printing is terminated. After printing is terminated between the platen roller 29 and the thermal head 30, the thermosensible paper 24 is conveyed and is cut by the cutter 18. After cutting, the driving motor 20 is reversed so that the thermal head 30 is released out of the pressing state against the platen roller 29. The recording paper sensor 14 serves to sense an end mark 24*c* indicating an end of the thermosensible paper 24 as shown in FIG. 7. Then, the driving motor 17 is reversed so that the thermosensible paper 24 is rolled around the paper roll 25, that is, the thermosensible paper 24 is stored in the cartridge 22. The end mark 24*c* is located on a non-printing surface 24*b* of the thermosensible paper 24.

According to the present embodiment, in case that the image data is printed on the thermosensible paper 24, the thermal head 30 is pressed against the platen roller 29 as shown in FIG. 6C and the printing is implemented as shown in FIGS. 6D and 6E. After the printing, as shown in FIG. 6F, the thermal head 30 is released out of the pressing state against the platen roller 29. It goes without saying that the thermal head 30 may be apart from the platen roller 30, though the pressing state is reduced according to the present embodiment.

FIG. 7 is a perspective view showing the end mark 24*c* indicating that the remaining length of the thermosensible paper 24 is less than a predetermined length.

As shown in FIG. 7, the thermosensible paper 24 is white on both sides. The printing surface 24*a* is subject to such a surface treatment as changing a surface color when it is heated up to 60° C. or more. By selectively actuating the heater elements 31 of the thermal head 30, therefore, printing of the image data is allowed to be implemented. The recording paper sensor 14 is capable of sensing the thermosensible paper 24, because the recording paper sensor 14 receives the increased quantity of light reflected on the rear surface 24*b* of the thermosensible paper 24 if the rear surface 24*b* is located on the optical axis 48 (see FIG. 3). The end mark 24*c* is coated in the range where the remaining length of the thermosensible paper 24 is less than a predetermined length. The representative end mark 24*c* is a band-like mark having a width of 20 mm and an interval of 10 mm from one end of the thermosensible paper 24. This end mark 24*c* extends in the range of 1 m from the end of the thermosensible paper 24 according to the CCITT (International Telegraph and Telephone Consultive Committee) standards. When the optical axis 48 of the recording paper sensor 14 reaches the end mark 24*c*, the recording paper sensor 14 receives the reduced quantity of light reflected from the thermosensible paper 24. The recording paper sensor 14 serves to discriminate the intensity of the reflected light for sensing the presence of the thermosensible paper 24 and the end mark 24*c*.

Figure 8:
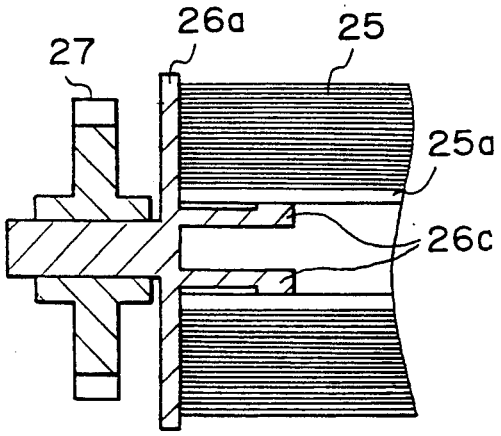
FIG. 8 is a sectional view showing a driving mechanism for the paper roll.
Figure 9:
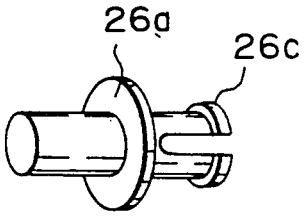
FIG. 9 is a perspective view showing a spool included in the driving mechanism included in FIG. 8.

FIG. 8 is a section view showing relation among the paper roll 25, the spool 26*a* and the gear 27. FIG. 9 is a perspective view showing the spool 26*a*.

Figure 10:
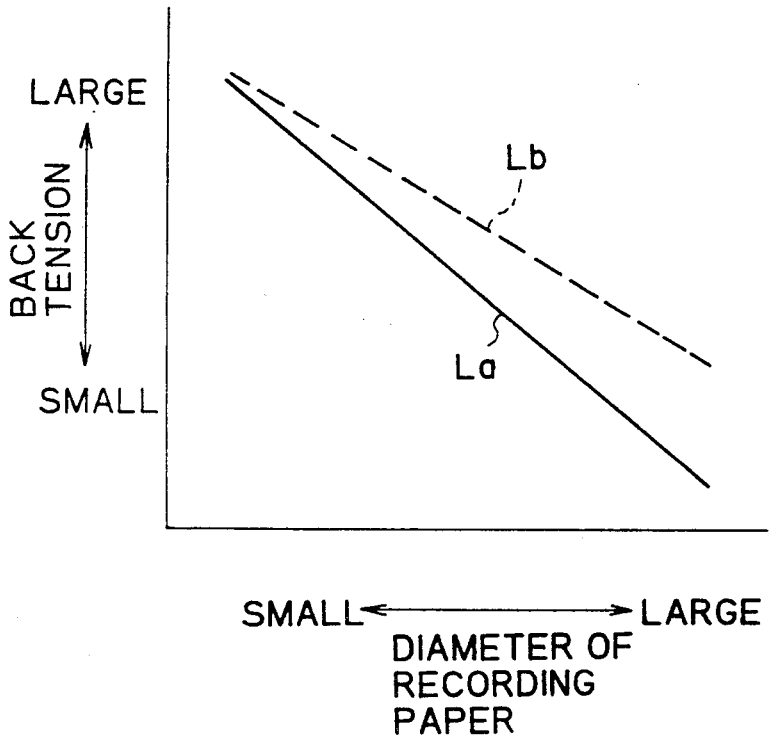
FIG. 10 is a plot showing tension exerted on the thermosensible paper.

As shown in FIGS. 8 and 9, the paper roll 25 provides a cylindrical core 25*a* inside of itself. The force of rotation is transmitted from the spool 26*a* to the core 25*a* through a frictional connecting portion 26*c* provided in the spool 26*a*. The frictional connecting portion 26*c* is so buoyant that it is allowed to be pressed on the inner peripheral surface of the core 25*a*. Hence, the tension may change according to the actual diameter of the paper roll 25 as shown in a real line La of FIG. 10. A broken line Lb of FIG. 10 indicates the tension changed in case that the paper roll 25 is rotatively held by the spools 26*a* and 26*b* only, that is, without the gear 27. According to this embodiment, as is apparent from FIG. 10, the tension changes more greatly so that it is easier to amend the curled paper.

Figure 11A:
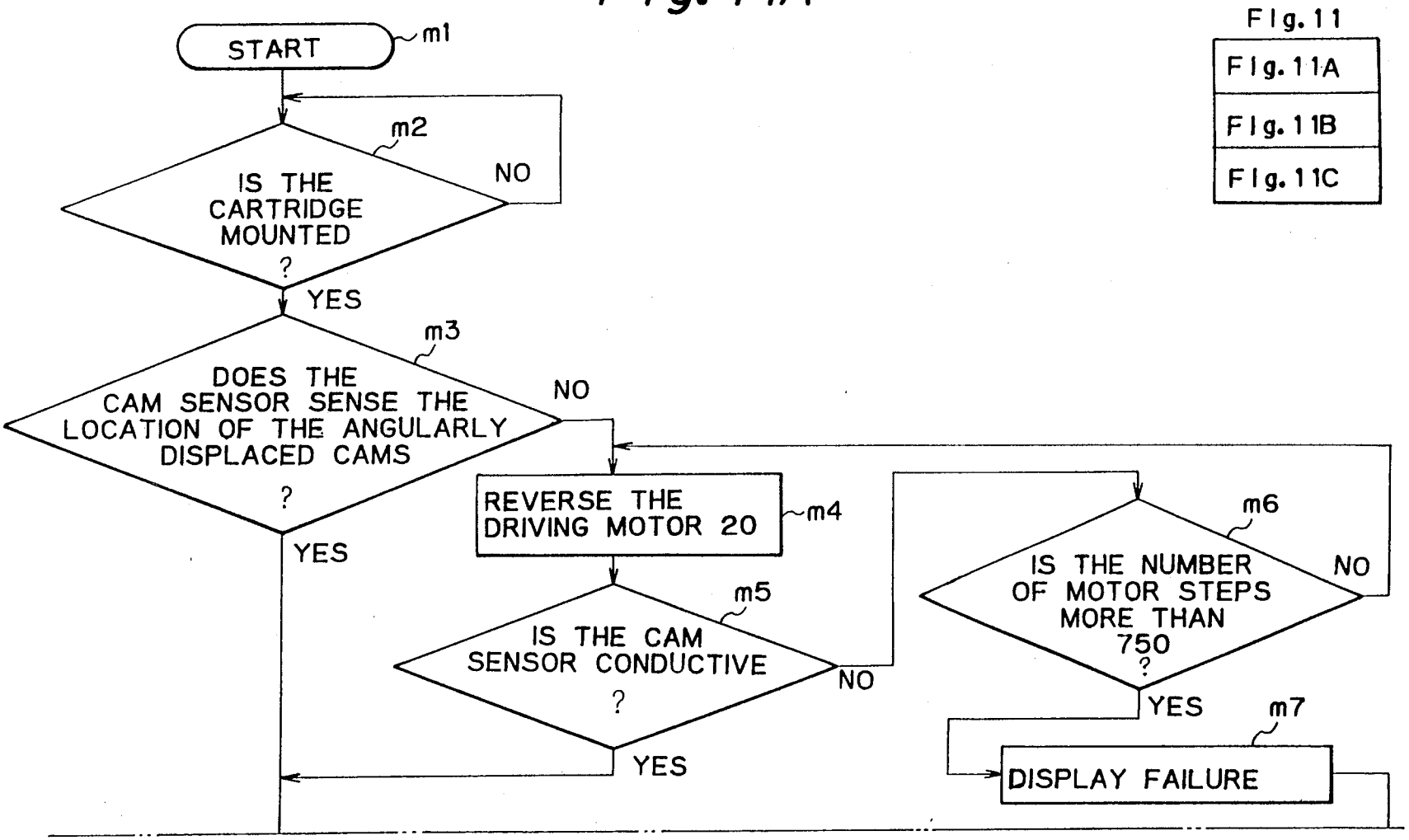
FIG. 11 shows FIGS. 11A to 11C which are flowcharts for illustrating the operation done in the thermal printing device.
Figure 11B:
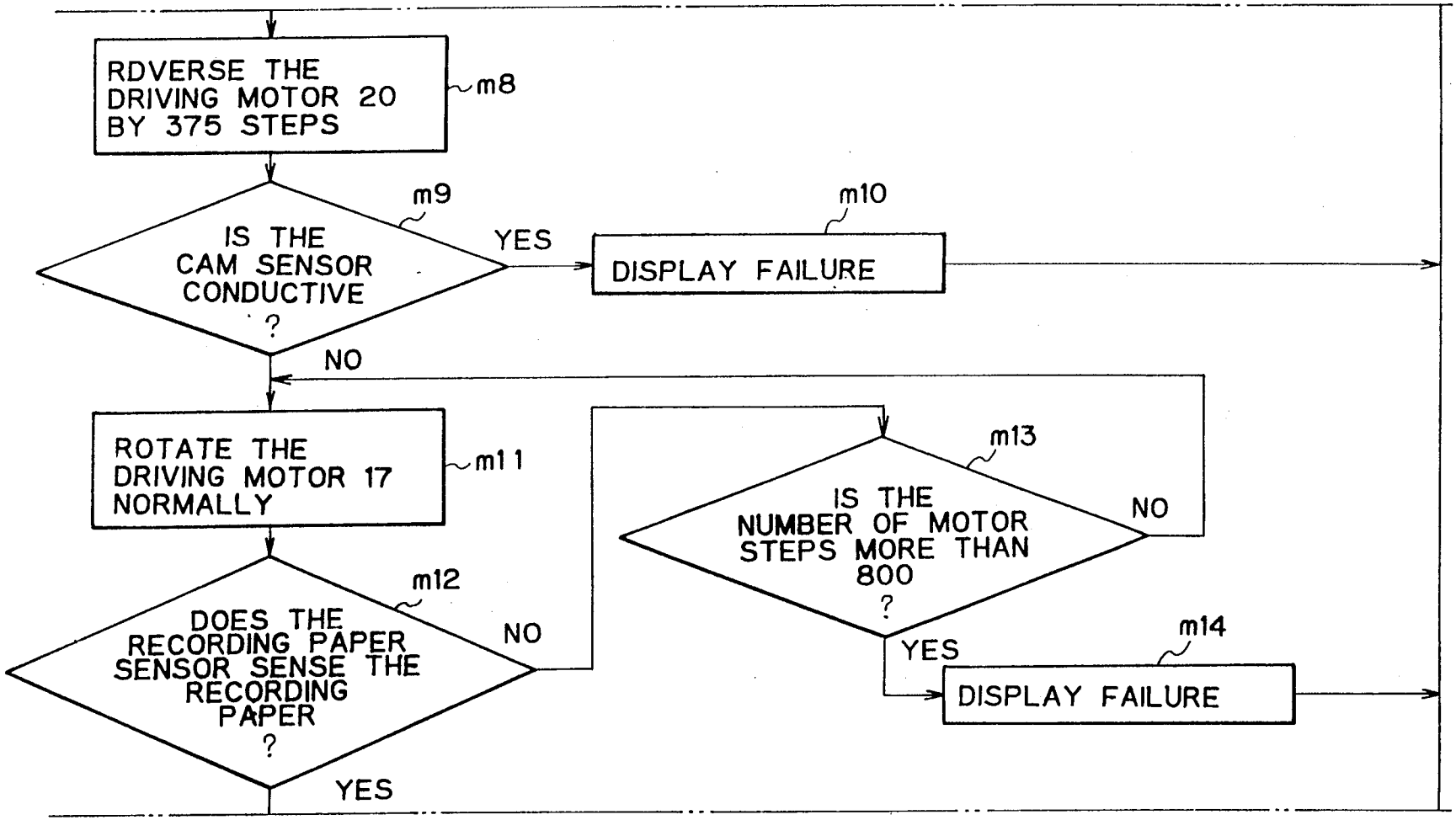
Figure 11C:
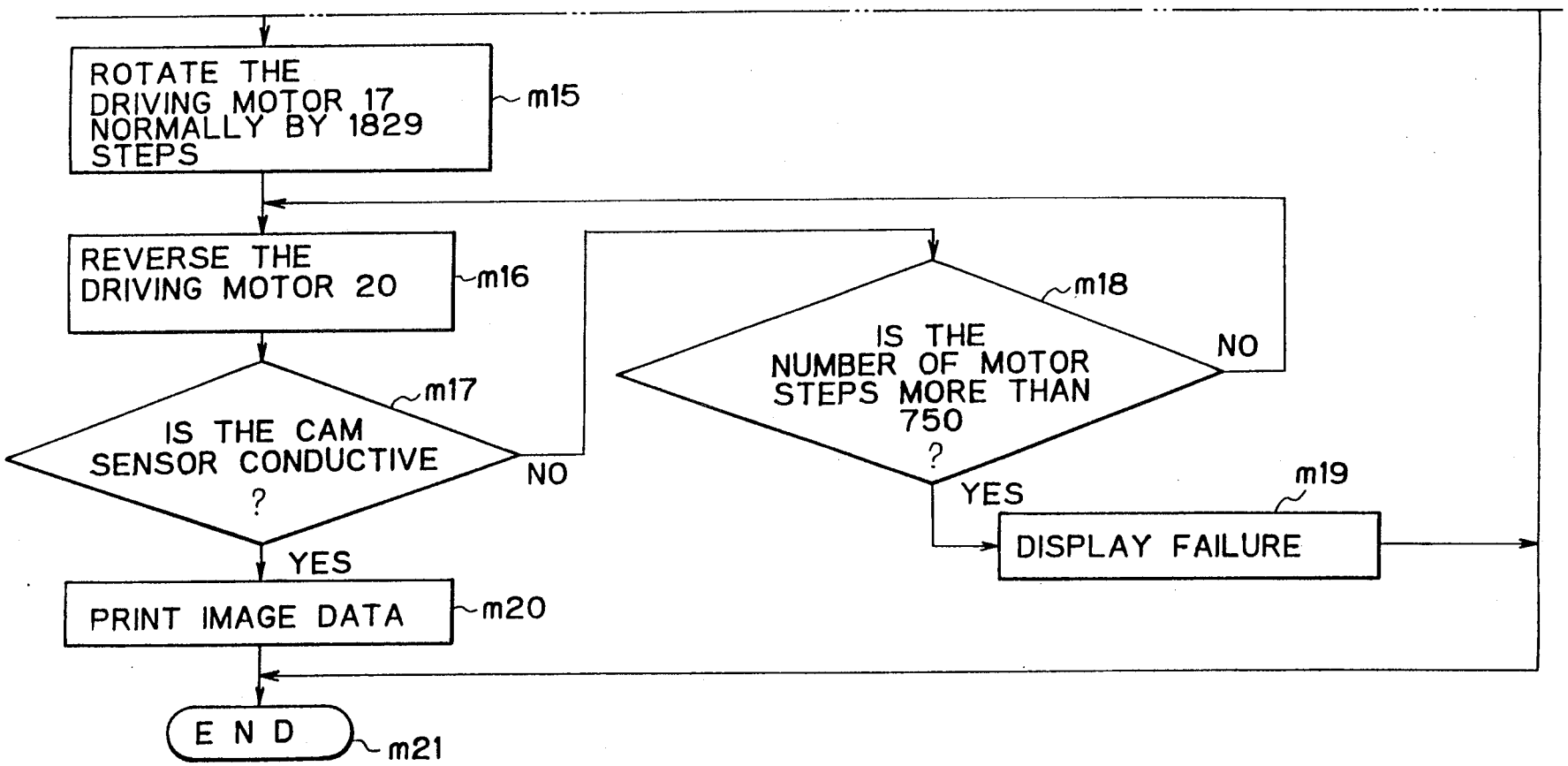

FIG. 11 is a flowchart showing process for making the thermosensible paper 24 ready for printing. This flowchart corresponds to FIGS. 6A to 6C.

As shown in FIG. 11, at steps m1 to m2, the control circuit 6 serves to determine whether or not the cartridge 22 is mounted depending on the output of the cartridge sensor 13. If the cartridge 22 is mounted, the process goes to a step m3.

Steps m3 to m10 correspond to the operation shown in FIG. 6A. At the step m3, the cam sensor 12 serves to sense the location of the angularly displaced cams 34. The cam sensor 12 is composed of a microswitch so that the cam sensor 12 becomes conductive only when it senses the pressing cams 34 are in the pressing state. If, therefore, the cam sensor 12 is not conductive, the precise locations of the pressing cams 34 are unobvious. Then, the process goes to the step m4. At the step m4, the driving motor 20 is reversed. The driving motor 20 employs a stepping motor. When the driving motor 20 is reversed by means of a pulse driving, at the step m5, it is determined whether or not the cam sensor 12 is made conductive. If the cam sensor 12 is not conductive, the process goes to the step m6 at which the number of motor steps used for reversing the driving motor 20 is compared with 750. If the number of motor steps is 750 or less, the process returns to the step m4. If the number of motor steps is more than 750, the process goes to the step m7 at which the display unit 21 displays that failure takes place. The numeral 750 is a proper number of motor steps required for rotating the cam shaft 35 once. If the number of the motor steps is more than that proper number, it is determined that failure takes place. If, at the step m3 or m5, the cam sensor 12 becomes conductive, the process goes to the step m8 at which the driving motor 20 is reversed by 375 steps. This 375 steps are a proper number of steps required for rotating the cam shaft 35 half. Hence, the pressing cams 34 are rotated half from the pressing state. Then, at the step m9, it is determined whether or not the cam sensor 12 is made conductive. If it is conductive, it is considered that failure takes place. At the step m10, the display unit 21 displays failure takes place.

Steps m11 to m16 correspond to the operation shown in FIG. 6B. At the step m11, the driving motor 17 is rotated normally. The force of the rotation is transmitted to the paper roll 25 through the gear 27 so that the thermosensible paper 24 may go outside. When the thermosensible paper 24 goes along the guide member 47 shown in FIG. 3 and reaches the optical axis 48 of the recording paper sensor 14, the recording paper sensor 14 senses the thermosensible paper 24, because the white non-printing side **24*b* of the thermosensible paper 24 reflects more quantity of light toward the paper sensor 14. If, at the step m12, the recording paper sensor 14 does not sense the thermosensible paper 24, the process goes to the step m13. Since the driving motor 17 employs a stepping motor as well, at the step m13, it is determined whether or not the number of motor steps is more than 800. The value of 800 is a proper number of steps allowing the thermosensible paper 24 to move from the opening 28 of the cartridge 22 to the optical axis 48 along the guide member 47 (see FIGS. 2 and 3). If, therefore, the number of motor steps is more than 800, the process goes to the step m14 at which the display unit 21 displays failure takes place. If, at the step m12, it is determined that the recording paper sensor 14 senses the thermosensible paper 24, the process goes to the step m15 at which the driving motor 17 is rotated normally by exactly 1829 steps. It results in allowing the thermosensible paper 24 to extend by a certain amount between the platen roller 29 and the thermal head 30**.

Steps m16 to m19 correspond to the operation shown in FIG. 6C. At the step m16, the driving motor 20 is reversed so that the thermal head 30 starts to press the platen roller 29. At the step m17, it is determined whether or not the cam sensor 12 is made conductive. If the cam sensor 12 is not made conductive, the pressing cams 34 do not reach the location where it can press the thermal head 30. At the step m18, the number of motor steps is compared with 750. The value of 750 is a proper number of steps required for rotating the cam shaft 35 once. If the number of steps is 750 or less, the process returns to the step m16 at which the driving motor 20 is reversed more. If, at the step m18, the number of motor steps is more than 750, at the step m19, the display unit 21 displays that failure takes place. If, at the step m17, the cam sensor 12 becomes conductive, it means that the thermal head 30 presses the platen roller 29. At the proceeding step m20, printing is implemented.

According to the present embodiment, when the operation at the step m15 is terminated, the thermal printing device enters into a waiting state. The operations after the step m16 are carried out when the printing is performed. In addition, the foregoing numbers of the proper motor steps are variable according to the number of teeth of each gear.

Figure 12:
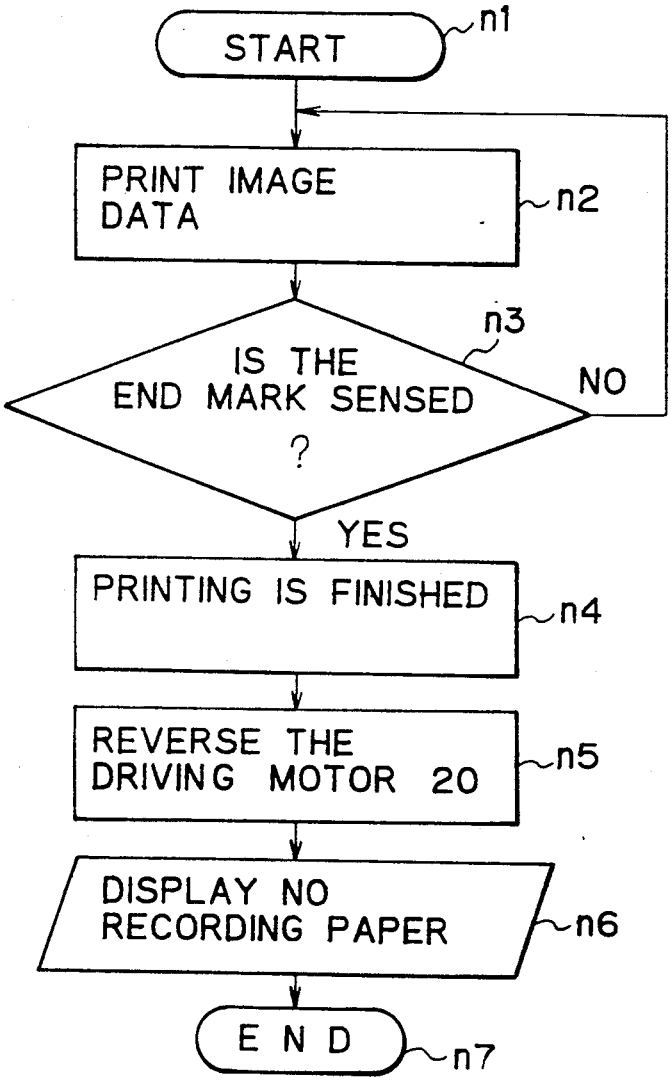
FIG. 12 is a flowchart for illustrating the operation done after sensing the end mark of the thermosensible paper.

FIG. 12 is a flowchart showing the operation after sensing the end mark according to the present embodiment.

As shown in FIG. 12, at steps n1 and n2, the control circuit 6 (see FIG. 1) performs the operation at the steps m1 to m21 shown in FIG. 11. That is, the platen roller 29 serves to convey the thermosensible paper 24 and the heater elements 31 of the thermal head 30 are selectively actuated for proper printing. As the printing on the thermosensible paper 24 is proceeding, the thermosensible paper 24 is being consumed and the diameter of the paper roll 25 is reduced. As mentioned above, the thermosensible paper 24 has the end mark **24*c* indicating that the remaining length is less than a predetermined length. The end mark 24*c* is intended to avoid the phenomenon where the thermosensible paper 24 is not terminated under the printing operation of the image data. That is, even if the end mark 24*c*** is sensed under the printing operation, it is possible to print the complete image data.

After printing the received image data at the step n2, it is determined whether or not the end mark **24*c* is sensed at a step n3. If the end mark 24*c* is not sensed, the process returns to the step n2 at which the printing is continued. If the end mark 24*c*** is sensed, the process goes to a step n4 at which the image data under printing is completely printed as one image.

At a step n5, the driving motor 20 is reversed and the thermal head is released out of the pressing state against the platen roller 29. Then, at a step n6, the display unit 21 displays a message indicating no thermosensible paper 24. At a step n7, the thermal printing device stops the operation in the state that the thermal head 30 is released out of the pressing state against the platen roller 29 and enters into a waiting state. After the paper roll 25 is replaced with a new one, the process can start from the step n1 again. When the paper roll 25 is replaced on the way of receiving the image data about two or more images, the remaining image data is printed.

Figure 13:
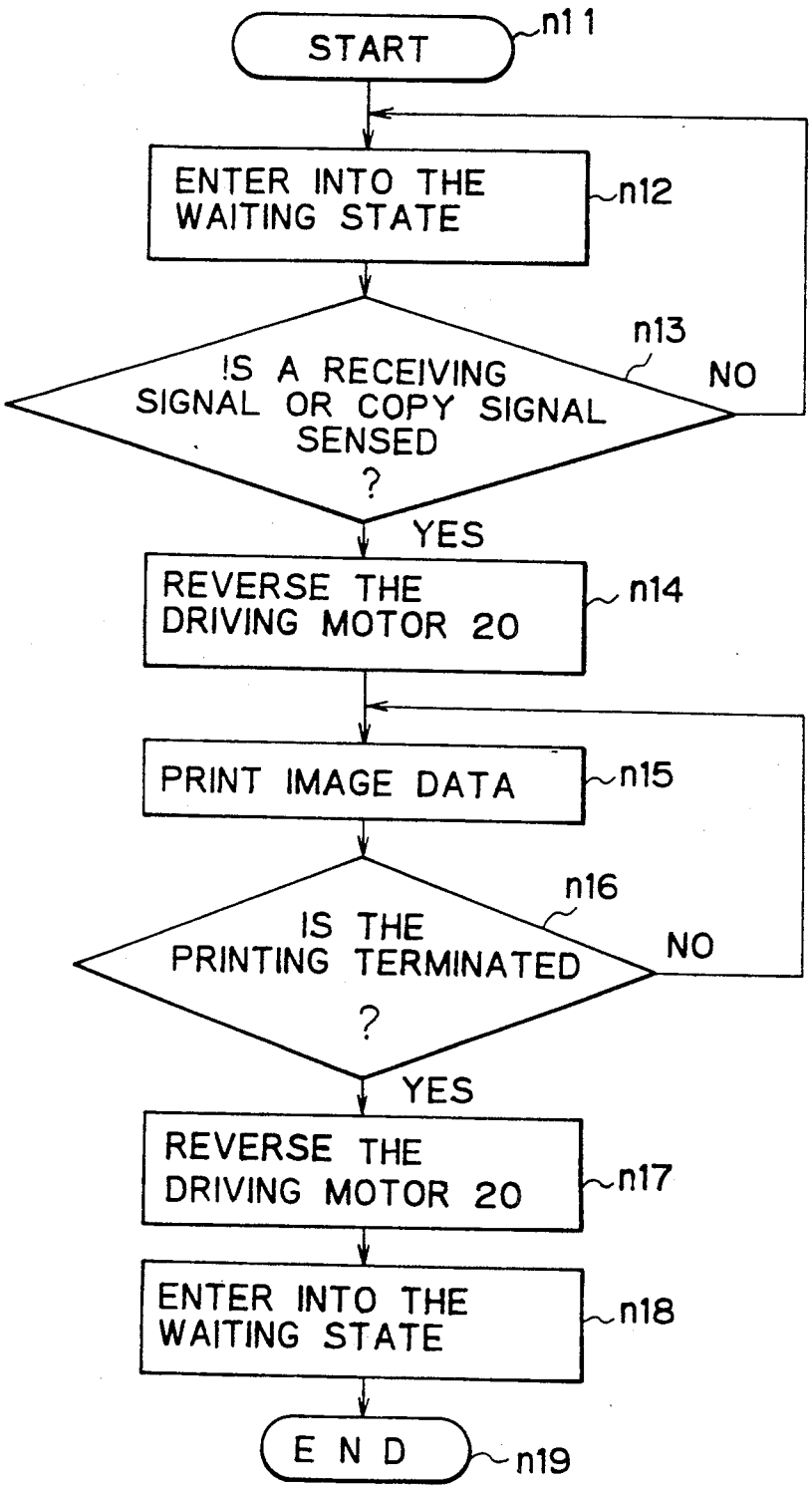
FIG. 13 is a flowchart for illustrating the printing operation done in the thermosensible paper.

FIG. 13 is a flowchart for illustrating another printing operation.

As shown in FIG. 13, at steps n11 to n12, the control circuit 6 (see FIG. 1) enters into the waiting state when the operation at the step m15 (see FIG. 11) is terminated. The CPU **6*a* included in the control circuit 6 continues the waiting state until the image data is received from the public telephone circuit c1 through the network control circuit 2 and the modem 7 (see FIG. 1) or a copy is required by the operation unit 8. The copy means the steps of reading an original as image data from the reading unit 9 and printing the image data on the thermosensible paper 24 by using the printing unit 10. This copy function makes it possible to make sure of the printed data before transmitting the image data. At a step n13, if no signal is sensed for receiving the image data or requesting the copy, the process returns to the step n12 at which the thermal printing device continues the waiting state. If any signal is sensed at the step n13, the process goes to a step n14. At the step n14, the driving motor 20 is reversed so that the pressing cams 34 are angularly displaced. It results in allowing the thermal head 30 to be pressed against the platen roller 29. As the thermosensible paper 24 is tightly held between the thermal head 30 and the platen roller 29, at a step n15, the heater elements 31** are selectively actuated so as to implement the printing of the image data. Then, at a step n16, it is determined whether or not an indication is issued for an end of printing. If no indication is issued for the end of printing, the process returns to the step n15 at which the printing is continued. In case that the control circuit 6 serves to sense an end signal of the sensed image data or an end of the image data to be copied, the indication for the end of printing is issued. If the indication is issued at the step n16, the process goes to a step n17 at which the driving motor 20 is reversed, resulting in releasing the thermal head 30 out of the pressing state against the platen roller 29. Then, at a step n18, the thermal printing device enters into the waiting state like the step n12.

As mentioned above, though the pressure given between the thermal head 30 and the platen roller 29 is changed by angularly displacing the pressing cams 34, the thermosensible paper 24 is being tightly held between the thermal head 30 and the platen roller 29. It results in making it possible to smoothly convey the thermosensible paper 24 through the effect of the rotation of the platen roller 29. In the waiting state at the step n12 or n18, it goes without saying that the thermal head 30 may be apart from the platen roller 29.

Figure 14:
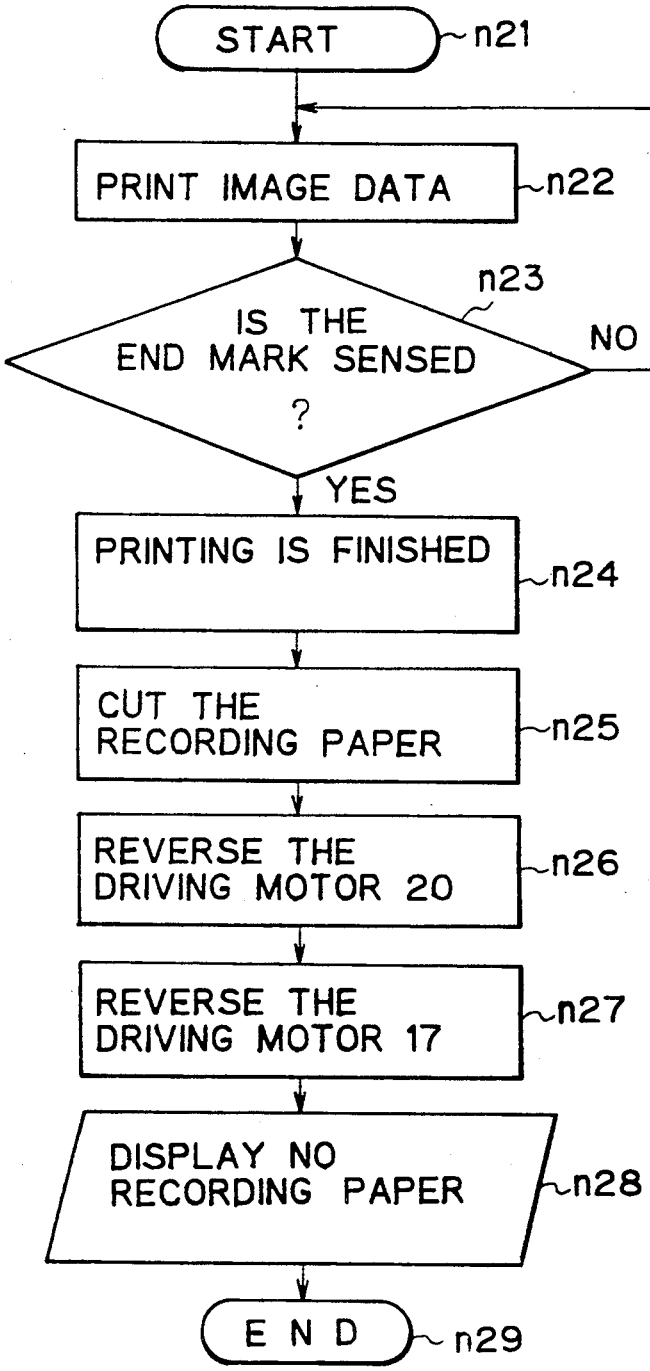
FIG. 14 is a flowchart for illustrating the other operation done after sensing the end mark of the thermosensible paper.

FIG. 14 is a flowchart for illustrating the other operation after sensing the end mark 24*c*.

As shown in FIG. 14, at steps n21 and n22, the control circuit 6 (see FIG. 1) serves to perform the operation at the steps m1 to m21 shown in FIG. 11. The platen roller 29 serves to convey the thermosensible paper 24 and the heater elements 31 of the thermal head 30 are selectively actuated for implementing the printing. As the printing proceeds, the thermosensible paper 24 is being consumed, resulting in reducing the diameter of the paper roll 25. On the paper roll 25, the end mark 24*c* is provided indicating that the remaining length of the thermosensible paper 24 is less than a predetermined length. This end mark 24*c* is provided to avoid the termination of the thermosensible paper 24 on the way of printing one complete image. That is, in case that the end mark 24*c* is not sensed before starting the printing but is sensed in printing, it is possible to print the complete image without interrupting one image.

After printing the received image data at the step n22, at a step n23, it is determined whether or not the end mark 24*c* is sensed. If the end mark 24*c* is not sensed, the process returns to the step n22 at which the printing is continued. If the end mark 24*c* is sensed, the process goes to a step n24 at which one complete image is printed.

At a step n25, after the printing, the thermosensible paper 24 is cut out by the cutter 18 (see FIG. 6F).

At a step n26, the driving motor 20 is reversed so that the thermal head 30 is released out of the pressing state against the platen roller 29. Then, at a step n27, the driving motor 17 is reversed so that the remain of the cut thermosensible paper 24 is rolled around the paper roll 25. At a step n28, the display unit 21 serves to display a message indicating no thermosensible paper 24. At a step n29, the operation is terminated in the state that the press of the thermal head 30 against the platen roller 29 is released. Then, the present thermal printing device enters into the waiting state. When the paper roll 25 is replaced with a new one, the printing operation at the steps n21 to n29 is made possible. In case that the paper roll 25 is replaced on the way of receiving the image data concerning two or more images, the remain of the image data is printed.

Figure 15:
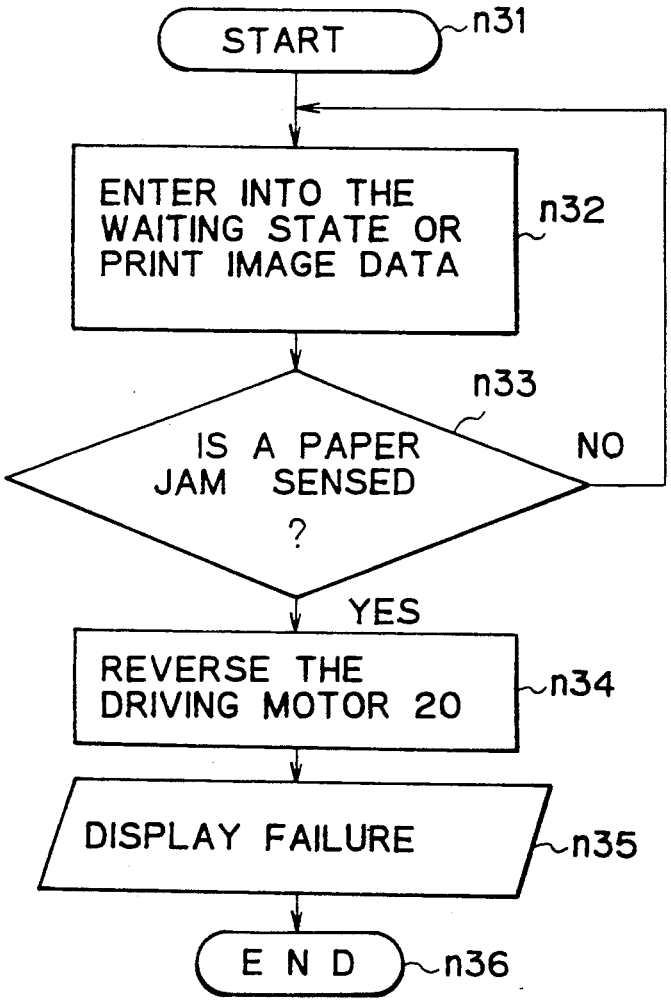
FIG. 15 is a flowchart for illustrating the other printing operation done in the thermal printing device.

FIG. 15 is a flowchart for illustrating the other printing operation.

As shown in FIG. 15, at steps n31 and n32, the control circuit 6 operates to convey the thermosensible paper 24 until the operation at the step m15 (see FIG. 11) is terminated or at the step m20. If, at a step n33, the paper jam sensor 15 served as a sensor for abnormal conveyance does not issue a signal indicating that a paper jam is sensed, the process returns to the step n32 at which the conveyance of the thermosensible paper 24 is being continued. If, at the step n33, the paper jam is sensed, the conveyance of the thermosensible paper 24 is stopped. Then, the process goes to a step n34 at which the driving motor 20 is reversed so that the pressing cams 34 are angularly displaced for releasing the thermal head 30 out of the pressing state against the platen roller 29. Proceeding to a step n35, the display unit 21 displays a message indicating failure takes place. At a step n36, the present thermal printing device enters into the waiting state.

As mentioned above, though the pressure given between the thermal head 30 and the platen roller 29 is changed by angularly displacing the pressing cams 34, the thermosensible paper 24 is being tightly held between the thermal head 30 and the platen roller 29. It results in making it possible to smoothly convey the thermosensible paper 24 through the effect of the rotation of the platen roller 29. In the waiting state at the step n32, it goes without saying that the thermal head 30 may be apart from the platen roller 29.

Figure 16:
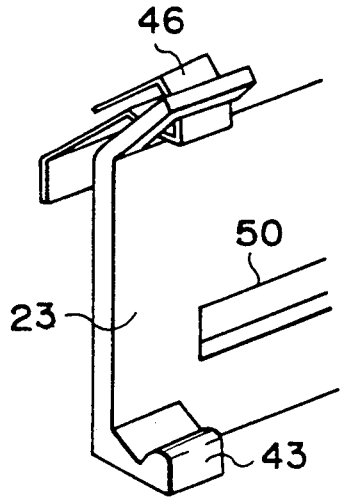
FIG. 16 is a perspective showing the other construction for mounting a cartridge to a cabinet.
Figure 17:
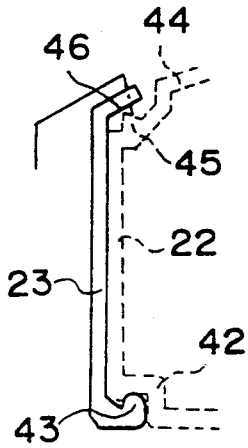
FIG. 17 is a sectional view showing the state where the cartridge is mounted to the cabinet in the construction shown in FIG. 16.

FIGS. 16 and 17 shows the other construction for mounting the cartridge 22. FIG. 16 is a perspective view showing the construction of the cabinet 23 and FIG. 17 is a sectional view showing how the cartridge 22 is mounted on the cabinet 23.

As shown in FIGS. 16 and 17, the cabinet 23 provides a locking spring 46 provided at an upper portion thereof and a projection 43 integrally formed at a lower portion thereof. The cabinet 23 provides an opening 50 for guiding the thermosensible paper 24. When mounting the cabinet 23, the jointed side between the cartridge 22 and the cabinet 23 is planar. At the lower portion of the joint, the projection 43 of the cabinet 23 is fitted into the concave provided at the lower end 42 of the cartridge 22. The cartridge 22 has an upper end 44 fixed by the locking spring 46. The upper end 44 has a lock supporting portion 45 to which the locking spring 46 is fitted, resulting in fixing the cartridge 22 on the cabinet 23.

Figure 18:
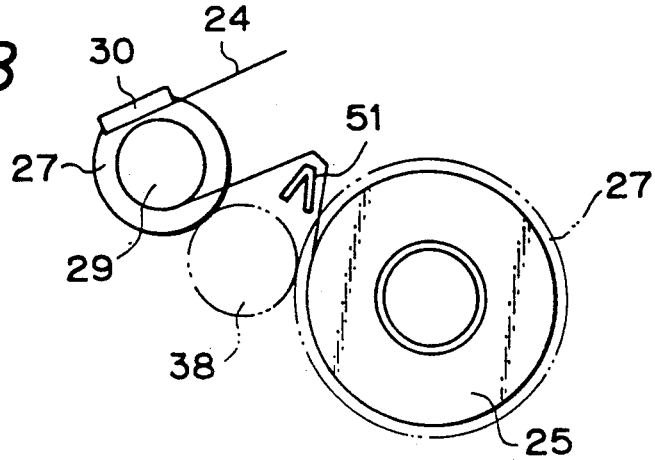
FIG. 18 is a view showing the other construction for amending a curled thermosensible paper.

FIG. 18 shows the other construction for conveying the thermosensible paper 24.

As shown in FIG. 18, on the way of conveying the thermosensible paper 24 from the paper roll 25 to the platen roller 29, an amending plate 51 is provided for amending the curled thermosensible paper 24 to be extended in the direction of conveying. The amending plate 51 is bent like a reversed V character and makes contribution to amending the curled thermosensible paper 24 sufficiently.

According to the present embodiment, as mentioned above, for the purpose of pressing the thermal head 30 against the platen roller 29, the driving motor 20 for transmission is reversed. By employing the method of reversing the driving motor 20, the present thermal printing device may be reduced in size and manufactured at lower cost. However, another driving motor dedicated for the purpose or a plunger may be provided. Alternatively, the platen roller 29 may be pressed against the fixed thermal head 30.

Further, while the paper roll 25 is accommodated in the cartridge 22 to be loaded and unloaded to the cabinet 23 according to the present embodiment, the paper roll 25 may be directly accommodated in the cabinet 23 of the facsimile apparatus 1. As another method, the cartridge 22 may be provided outside of the cabinet 23 for replacing the paper roll 25 more rapidly.

Provision of two or more cartridges may result in reducing the time needed for replacing the paper roll 25. Hence, if it is necessary to replace the paper roll 25 on the way of receiving the image data to be printed, it is possible to reduce an interrupting time. Moreover, the thermal printing device according to this embodiment is allowed to move in the state that the thermosensible paper 24 is tightly held between the thermal head 30 and the platen roller 29, resulting in facilitating preparation for movement of the thermal printing device and making it possible to immediately use the thermal printing device after the movement.

Further, according to the foregoing embodiment, the recording paper sensor 14 senses the end mark 24*c*. However, it may be possible to provide a sensor dedicated for the purpose.

In the foregoing description, the thermal printing device according to the invention has been applied to the receiving section of the facsimile apparatus. However, it may be applied to another apparatus for printing various kinds of data. For example, the present thermal printing device may be used for printing continuous meteorological data as a signal or a signal for controlling a factory or a plant.

Further, according to the foregoing embodiment, when the end of the printing is sensed, the pressure of the platen roller 29 against the thermal head 30 is automatically released. When the thermosensible paper 24 is replaced, therefore, it is not necessary to take the troublesome operation of releasing the thermosensible paper 24 out of the pressure given by the platen roller 29 and the thermal head 30 so that any user can easily and rapidly replace the thermosensible paper 24. In particular, when even a user unfamiliar to the operation replaces the thermosensible paper 24, he or she can easily remove the finished thermosensible paper 24 around the platen roller 29.

Alternatively, for example, when the remaining length of the thermosensible paper 24 is less than a predetermined length, the pressure caused between the platen roller 29 and the thermal head 30 is automatically released. Hence, it is simply possible to remove the rolled paper 25 and mount the new thermosensible paper.

Further, since the thermosensible paper 24 is allowed to be rapidly and reliably replaced, it results in reducing the interrupting time of the data receipt even if the thermosensible paper 24 is used up while the image data is being received.

The thermal printing device keeps the waiting state until the new thermosensible paper is mounted. Even in case the waiting time is longer than expected as a result of the clumsy operation, it is possible to prevent an eternal compression distortion from being caused on the platen roller 29, because no pressure is applied to the platen roller 29 by the thermal head 30.

Further, for example, when the printing is finished, the pressure of the platen roller 29 against the thermal head 30 is automatically released. Hence, when no printing is done, it is possible to prevent the thermal head 30 from being pressed against the platen roller 29 for a considerable time.

As mentioned above, after terminating the printing, the pressure of the thermal head 30 against the platen roller 29 is released. The thermal printing device has to keep the waiting state for a considerable time until the image data is received. By releasing the pressure of the thermal head 30 against the platen roller after terminating the data printing, under the foregoing waiting state, the platen roller 29 is not transformed even if the same portion of the platen roller 29 comes into contact with the thermal head 30. It is therefore possible to prevent occurrence of an eternal compression distortion and avoid transformation of the platen roller 29, resulting in implementing exact printing of the image data.

Since no substantial transformation is caused in the platen roller 29, it is possible to employ an inexpensive rubber material for the platen roller 29, resulting in reducing the manufacturing cost of the device. Since a large pressure is caused for quite a short time, the present thermal printing device does not need so large stiffness as the known thermal printing device. Hence, the present thermal printing device can be reduced in size and made lightweight.

Further, in case the thermal printing device is transferred in use, the smaller pressure caused between the thermal head 30 and the platen roller 29 serves to buffer the external shock applied from the thermal head 30 to the platen roller 29, resulting in preventing transformation of the platen roller 29.

Further, for example, when an abnormal state takes place in the conveyance of the thermosensible paper 24, the pressure caused between the platen roller 29 and the thermal head 30 is automatically released. It is therefore unnecessary to take the step of releasing the pressure caused therebetween, resulting in easily and rapidly removing the cause of the abnormal state appearing in the conveyance of the thermosensible paper 24.

Since the thermal printing device is capable of rapidly recovering the abnormal state in the conveyance of the thermosensible paper 24, it is possible to reduce the printing-interrupting state as much as possible.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal printing device for printing an image data on a thermosensible paper, comprising:

a platen roller for conveying said thermosensible paper;

a thermal head having a plurality of heater elements provided in opposition to said platen roller;

pressing means for pressing said thermal head against said platen roller with said thermosensible paper laid therebetween when the image data is printed on said thermosensible paper;

releasing means for controlling said pressing means to release said thermal head out of a pressing state against said platen roller under predetermined conditions;

image data detecting means for detecting a reception of the image data to be printed;

jam detecting means for detecting an occurrence of a paper jam along a conveying path of said thermosensible paper;

end signal sensing means for sensing an end signal of the image to be printed;

paper sensing means for sensing a presence of said thermosensible paper;

end mark sensing means for sensing an end mark arranged on said thermosensible paper, said end mark indicating that a remaining length of said thermosensible paper is less than a predetermined length;

cutting means for cutting said thermosensible paper;

rewinding means for rewinding said thermosensible paper cut by said cutting means; and display means for displaying a message indicating an occurrence of failure.

2. A thermal printing device according to claim 1, wherein said plurality of heater elements are arranged in parallel to an axis of said platen roller.

3. A thermal printing device according to claim 1, wherein said end mark sensing means includes a record paper sensor comprising a reflective type optical sensor.

4. A thermal printing device according to claim 1, wherein said end mark is located on an opposite side of said thermosensible paper to a side on which the image data is printed.

5. A thermal printing device according to claim 1, wherein said jam detecting means for detecting paper jam along a conveying path of said thermosensible paper includes a paper jam sensor comprising a reflective type optical sensor.

6. The thermal printing device of claim 1, wherein said releasing means controls said pressing means to release said thermal head out of a pressing state against said platen roller and said displaying means displays a message of an occurrence of failure in a case where said paper sensing means senses no presence of said thermosensible paper when said image data detecting means detects a reception of image data to be printed or in a case where said paper sensing means senses a presence of said thermosensible paper, said end mark sensing means senses no end mark, and said jam detecting means detects an occurrence of a paper jam, when said image data detecting means detects a reception of image data to be printed.

7. The thermal printing device of claim 1, wherein said releasing means controls said pressing means to release said thermal head out of a pressing state against said platen roller, said displaying means displays a message of an occurrence of failure, said cutting means cuts said thermosensible paper, and said rewinding means rewinds said thermosensible paper in a case where said paper sensing means senses a presence of said thermosensible paper and said end mark sensing means senses a presence of said end mark, when said image data detecting means detects a reception of image data to be printed.

8. The thermal printing device of claim 1, wherein said releasing means controls said pressing means to release said thermal head out of a pressing state against said platen roller and said cutting means cuts said thermosensible paper in a case where said paper sensing means senses a presence of said thermosensible paper, said end mark sensing means senses no end mark, said jam detecting means detects no occurrence of a paper jam, and said end signal detecting means detects said end signal when said image data detecting means detects a reception of image data to be printed.

* * * * *